United States Patent [19]

Ellingson et al.

[11] 4,242,790

[45] Jan. 6, 1981

[54] METHOD OF MAKING AN ELECTRICAL CONNECTOR CONTACT

[75] Inventors: Dennis L. Ellingson, Sidney; Paul D. Niles, Bainbridge; Richard W. Normann, Otego; Theodore L. Wilklow, Sidney, all of N.Y.

[73] Assignee: The Bendix Corporation, Southfield, Mich.

[21] Appl. No.: 946,690

[22] Filed: Sep. 28, 1978

Related U.S. Application Data

[62] Division of Ser. No. 863,366, Dec. 22, 1977.

[51] Int. Cl.[3] ..... H01R 43/02

[52] U.S. Cl. ..... 29/879; 339/49 R; 339/275 T

[58] Field of Search ..... 29/630 A, 630 R, 630 F, 29/630 G, 629, 630 D, 628, 876, 879; 228/4.5; 339/49 R, 275 T; 140/111; 300/21

[56] References Cited

U.S. PATENT DOCUMENTS

| | | | |
|---|---|---|---|
| 411,637 | 9/1898 | Batchelor et al. | 140/111 |
| 2,276,571 | 3/1942 | Grypma | 29/630 F |
| 2,325,629 | 8/1943 | Peterson | 300/21 |
| 2,603,680 | 7/1952 | Snyder | 29/630 A X |
| 3,255,430 | 6/1966 | Phillips | 29/630 A |
| 3,277,560 | 10/1966 | Frank et al. | 29/630 D |
| 3,488,842 | 1/1970 | Rochette et al. | 29/628 X |
| 3,725,844 | 4/1973 | McKeown et al. | 339/49 R |
| 4,098,447 | 7/1978 | Edson et al. | 228/4.5 |

*Primary Examiner*—Francis S. Husar
*Assistant Examiner*—C. J. Arbes
*Attorney, Agent, or Firm*—Kenneth A. Seaman; C. Dennis Lacina; Raymond J. Eifler

[57] ABSTRACT

An electrical contact (10) for an electrical connector including a sleeve (20) and a plurality of axially-aligned fine wires (30), with each wire having an acutely angled end portion (32) at one end thereof and with the plurality of wires secured together at the other end to form a bundle (40). Preferably, the wires are secured together by a weld (50) formed by a capacitor (210) discharging across a gap (300) to the wires, although other securing methods could be used. The bundle (40) of wires then may be inserted into the sleeve of the contact (10) with the angled ends (32) forward in the sleeve (20) and the weld (50) rearward in the sleeve. Said sleeve then is crimped inwardly (25) forward of, or including, the welded portion, to hold the bundle (40) in place within the sleeve.

9 Claims, 8 Drawing Figures

FIG. 1
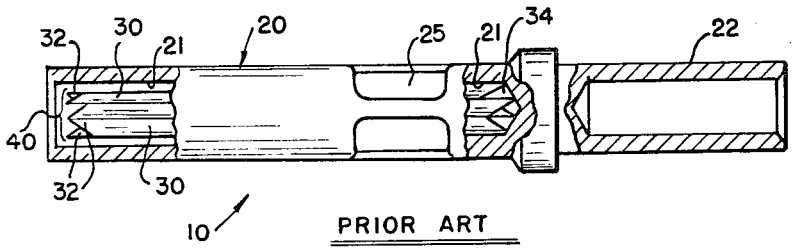
FIG. 2
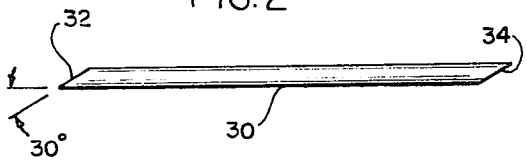
FIG. 3
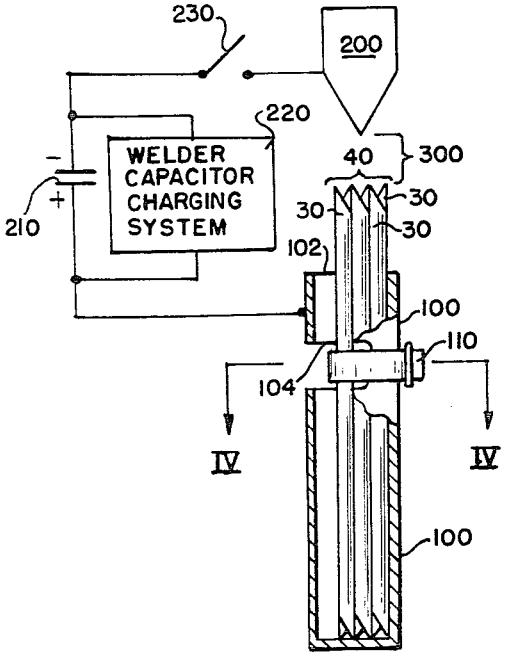
FIG. 4
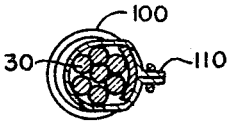
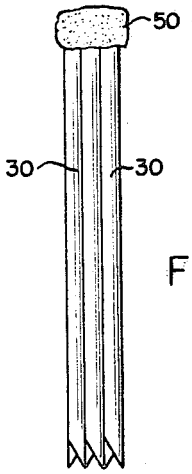
FIG. 5

METHOD OF MAKING AN ELECTRICAL CONNECTOR CONTACT

This is a division of application Ser. No. 863,366, filed Dec. 22, 1977.

CROSS REFERENCE TO RELATED PATENTS

The present invention is related to and an improvement upon U.S. Pat. No. 3,725,844 issued Apr. 3, 1973, to McKeown et al for "Hermaphroditic Electrical Contact", assigned to the assignee of the present invention. This patent is hereafter referred to as the "Brush Contact Patent" and the specification and drawings thereof are hereby specifically incorporated herein by reference.

BACKGROUND OF THE INVENTION

This invention relates to electrical contacts for an electrical connector and a method of making the contacts. More specifically, this invention relates to electrical contacts of the type wherein a plurality of fine wires are held together and axially-aligned in a bundle within a sleeve and the wires provide surfaces for mating and electrical conductivity with a second contact in another connector. The second contact may be either a similar contact or one of a plurality of conventional but dissimilar contacts.

Electrical contacts of the type including a plurality of axially-aligned fine wires held in a sleeve are old and known in the prior art, as evidenced by the Brush Contact Patent. Such a contact typically includes a plurality of wires, each with acutely angled forward end portions and held within a holder simply by a crimp of the holder radially inwardly providing a frictional retention among the wires and between the holder and the plurality of wires.

The manufacture of electrical connectors of the type described in the Brush Contact Patent is not the ultimate in simplicity or cost effectiveness. The manufacturing requires that the individual wires be separately made, handled, and channeled into a sleeve which is only fractionally larger internally. Channeling the wires into such a sleeve may damage the wires in some instances.

The crimping operation in the manufacture of the prior art electrical connector is necessary to securely hold all of the wires together and within the sleeve. This presents an undesirable feature of requiring an undesirably high force to secure all the wires within the sleeve.

The electrical resistance of the prior art contact depends partially on the quality of the crimp, so a poor crimp can significantly increase the electrical resistance of the contact. Since a low resistance in a contact is necessary, particular care (with resulting expense) was directed to obtaining a good crimp.

In some instances it is desirable to verify that the correct number of wires (perhaps within a small tolerance) is included in the plurality of wires. In the prior art methods of making such a contact, a mechanical way of determining assembly with the wires in the comparatively heavy sleeve against a nominal weight. The heavy sleeve makes it difficult to determine the exact number of wires included. The number of wires is important to the retention of wires within the sleeve and to the electrical resistance of the bundle in prior art applications.

Electrical contacts including a welded end are not themselves new. One such contact including a welded end is shown in a prior art patent (Re 25,798) to Platz et al for "Plug-In Connector". Such a contact was formed to have a relatively high mating force which is undesirable and a relatively high manufacturing cost.

The foregoing and other limitations of the prior art present problems in the manufacturing of the contact and the subsequent reliability of such a contact.

SUMMARY OF THE INVENTION

The present invention overcomes the limitations of the prior art by providing an electrical contact which includes a one-piece sub-assembly of a plurality of axially-aligned electrically conducting wires secured together at one end. Such an assembly is easier to handle, and, in some instances, less expensive to make and assemble and one which has a higher reliability and lower electrical resistance in use.

The electrical contact of the present invention obtains a higher reliability while requiring a smaller force to secure the wires within the sleeve and has a significantly lower mating force than the prior art electrical contact described in patent Re 25,798.

The present invention is an electrical contact comprising a plurality of straight fine wires (30) each with an acutely angled forward end portion (32) and axially aligned to form a bundle (40). The wires, at the rear end portion of the bundle (40), are secured one to another by a weld (50) to provide a contact with a lower electrical impedance and a greater mechanical resistance to disassembling forces. The welded bundle (40) is then inserted into an electrical connector sleeve (20) with the rear end of the bundle located rearwardly within the sleeve, and a crimp (25) in the sleeve secures the bundle (40) with the weld (50) within the sleeve. The location of the crimp (25) is advantageously located in the portion of the sleeve (20) forward of the welded (or enlarged) portion or in the portion of the sleeve including the welded portion. Such a crimping arrangement coacts with the weld to secure the wires better within the sleeve and to provide a lower electrical resistance and a higher mechanical resistance to disassembly.

A welded brush bundle of the present invention could be treated as a sub-assembly, and inventoried in the bundle form, ready for insertion.

Such a sub-assembly could be easily weighed (or balanced against an appropriate standard) to determine whether the correct number of wires are included (perhaps within a given tolerance in the accepted number of wires).

Accordingly, it is an object of the present invention to provide a novel electrical contact for an electrical connector and a novel method of manufacturing the contact which is economical and which has a low mating force and low electrical resistance. Further, it is an object of the present inventon to provide a one-piece sub-assembly including a plurality of wires with a rear welded portion which may be separately manufactured, inspected and inventoried.

The foregoing and other objects and advantages of the present invention will be apparent to one skilled in the art in view of the following description and the accompanying drawings.

BRIEF DESCRIPTION OF THE DRAWINGS

FIG. 1 is a partial cross-sectional view of an electrical contact of the prior art with each of the wires forming the contact separately inserted and held together and within a sleeve by a crimping of the sleeve inward.

FIG. 2 is a magnified view of one of the contact wires of the electrical contact of FIG. 1.

FIG. 3 is a partial cross-sectional view of a bundle of fine wires used in the electrical contacts held in a sleeve for welding but prior to being welded.

FIG. 4 shows the bundle of FIG. 3 looking in the direction of the line 4—4 in FIG. 3.

FIG. 5 is a view of the bundle of fine wires following the step of welding the wires together to form a welded bundle, prior to insertion into a sleeve.

DETAILED DESCRIPTION OF THE DRAWINGS

Figure 6:
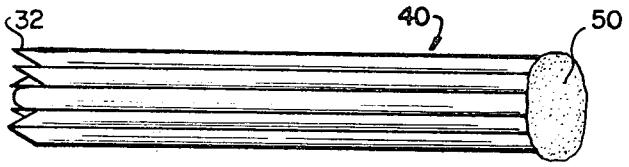
FIG. 6 shows a view of another, larger welded bundle of fine wires.

FIG. 1 depicts in partially cutaway view a form of a brush contact for an electrical connector which is known in the art, similar to that described in the Brush Contact Patent. The brush contact 10 includes a sleeve or holder 20 and a plurality of fine wires 30 arranged in a bundle 40.

The sleeve or holder 20 has a forward axial passage or socket 21 (for receiving the fine wires 30) and a rear portion 22 for an electrical connection (or termination). The rear portion 22 as shown in FIG. 1 is a socket for the insertion and attachment of an electrical wire. Other configurations of the rear portion of the holder 20 are known and may be substituted during the manufacturing of the holder, such other configurations include a printed circuit board tail and a solderless wire wrap tail, according to the type of electrical element which is being terminated in (or connected to) the contacts. The contact provides an electrical connection between the wire (or other termination) in the rear and the forward contact.

The fine wires 39 have acutely angled end portions 32 on at least the forward end of each wire. The rear portions 34 of the wires 30 are inserted in the holder 20 and held in place, typically by a crimped portion 25 of the holder to reduce the cross-section dimension of the holder to thereby hold the wires fixed with respect to the holder 20.

FIG. 2 shows a single fine wire 30 of such a brush contact. The wire is typically cylindrical and made of an electrically conducting material such as berylium copper. For ease in manufacturing and assembling, the forward end 32 and rear end 34 are typically formed with acutely angled end portions to eliminate a requirement that the wires be directionally oriented. As is shown, the end portions have an angle of 30° in this view, but a greater or lesser angle could be used.

FIG. 3 shows a bundle 40 of wires 30 which are in an electrically conducting welding holder (or socket) 100 for welding but not yet welded. The bundle 40 shown consists of seven wires, although more or less could be used. The bundle 40 at this state is common to both the prior art and to the present invention, at this stage of manufacture and assembly.

The holder 100 is generally cylindrical with an opening 102 at the top and is used only in preparation for and during the welding operation. The wires 30 which make up a single bundle 40 are channeled (or funneled) into the holder 100 through the opening 102 in preparation for welding.

The holder 100 is formed with a slot 104 which extends partially around the periphery of the holder intermediate the height of the holder. The slot 104 accommodates a spring clip 110 which is inserted around the holder 100 and which secures the wires 30 together with each other in a tight bundle and in contact with a portion of the inside wall of the holder 100.

A welding system suitable for making the welded bundle of this invention is shown generally in diagramatic form in FIG. 3. The welding system is a stored energy welding system which includes an electrode 200, a capacitor 210, a capacitor charging system 220 and a switch 230. The capacitor 210 is coupled with its cathode to the electrode through the switch 230 and with its anode to the holder 100 and through the holder 100 to the wires 30 in the bundle 40. The capacitor charging system 220 charges the capacitor to a predetermined, possibly variable voltage.

The electrode 200 is spatially located with respect to the proximate end portion of the bundle 40 to provide a suitable gap 300.

In operation of the welding system of FIG. 3, the capacitor charging system 220 charges capacitor 210 to a predetermined voltage. The switch 230 is closed (either manually or automatically), creating a potential (voltage) difference between the electrode 200 and the wires 30 in the bundle 40 approximately equal to the predetermined voltage, which causes an arc to cross the gap and bond the wires together.

One example of the apparatus used to accomplish the welding is as follows. For a seven wire bundle of the berylium copper wire of 0.008 inch diameter, a Superior Model 527A arc/percussive butt welder power supply was used. A capacitor of approximately 6400 microfarads, charged to approximately 90 volts, and a gap of 0.020 inches were used with good results. Other variations and modifications of such a welding schedule may be easily determined and are well within the skill of those working in the field.

FIG. 4 shows a cross sectional view of the bundle of wires 30 held by the spring clip in contact with each other and with the wall of the holder 100.

FIG. 5 shows a bundle 40 of wires 30 after the welding process. One end of the bundle is no longer the individual separate wire strands but rather an enlarged portion or nugget 50. As a result of the stored energy welding process described above, the bundle 40 after welding is slightly shorter in length than the wires 30 were originally. The enlarged welded portion or nugget 50 comprises a relatively small portion of the length (3–10%) of the welded assembly, a percentage which depends in part upon the length of the wire.

If the nugget 50 is formed by the stored energy welding system described previously, the nugget 50 is of the same material as the individual wires. This system has the advantage of not consuming additional material (which could change the weight of the bundle and make it difficult to determine the number of wires included in a particular bundle) and of not requiring clean-up of the welded bundle (i.e. excess solder and fluxes).

FIG. 6 illustrates a larger bundle 40 of wires similarly prepared with a forward acutely angled end portion 32 and a rear enlarged portion or nugget 50. Such a bundle would be suitable for greater current carrying capacity.

Figure 7:
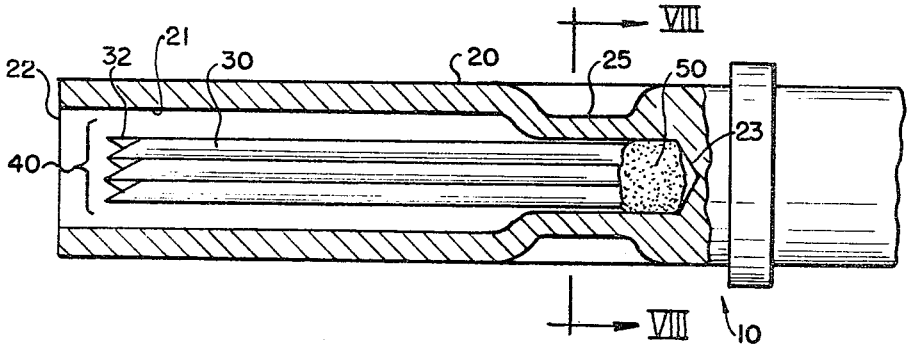
FIG. 7 shows a bundle of wires welded together and held within a sleeve.
Figure 8:
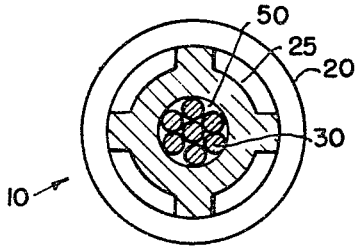
FIG. 8 is a view of the wires in the sleeve in FIG. 7 looking in the direction of line 8—8.

FIG. 7 shows a portion of an electrical contact 10 of the present invention with a welded bundle 40 of fine straight brush wires 30 inserted into a holder 20.

The holder 20 has an axial passage 21 extending rearwardly from a forward opening 22 to a rear stop 23 which may be formed in any one of several methods.

The welded bundle 40 of wires 30 (e.g. as shown in FIG. 5) is inserted through the forward opening 22 with the enlarged portion leading until the rear stop 23 is reached.

Thereafter, a portion of the sleeve or holder 20 is crimped radially inwardly to form a crimped portion 25. The crimped portion is advantageously formed either at or forward of the enlarged portion 50 to thereby captivate the bundle 40 within the holder by restricting the forward movement of the nugget 50 and therefore the bundle 40. Such an arrangement of the nugget and the crimp allows the use of a lower crimping force than would otherwise to required. Other resulting benefits are that the wires are better secured to one another and to the holder to provide both better mechanical attachment and a lower electrical resistance connection.

Other objects and advantages of the present invention will be apparent to those skilled in the art in view of the foregoing description. For example, other forms of welding such as tungsten-inert gas (tig) welding or percussive welding might be used, or a known substitute for welding (such as soldering) might be employed to advantage. Further, a different method of securing the bundle within the sleeve might be used without departing from the spirit of the present invention. The foregoing description accordingly should be considered as illustrative only and should not be interpreted to limit the scope of the present invention, which is defined by the following claims.

What is claimed is:

1. A method of assembling an electrical contact for an electrical connector, said contact including a plurality of wires held within a sleeve, the steps of the method comprising:

cutting a fine wire into a plurality of straight wire lengths having a primary axis and of approximately equal length;

forming a tapered portion onto one end of each wire length;

assembling the plurality of straight wire lengths into a bundle so that the axes of the wire lengths are generally parallel but non-coplanar one to one another and with the tapered end portion of each wire length being located at the same end of the bundle;

welding the wires together at the other end of the bundle;

inserting the welded bundle into the sleeve; and securing the bundle of wires to the sleeve.

2. A method of the type described in claim 1 wherein the step of welding the wires together further includes the making of a portion which extends outwardly from a cross-section of the bundle of wires to form an enlarged portion.

3. A method of the type described in claim 2 wherein the step of crimping is performed after the enlarged portion has been inserted into the sleeve and the step of crimping includes forming a portion of the sleeve forward of the enlarged portion to an interior dimension smaller than the cross section of the enlarged portion, whereby the bundle of wires is held within the sleeve.

4. A method of the type described in claim 1 wherein the step of welding includes the discharging of a capacitor charged to a voltage through an arc to the bundle whereby the voltage of the discharging capacitor arcs to the bundle and performs the welding.

5. A method including the steps decribed in claim 1 wherein the step of securing the bundle within the sleeve comprises the step of crimping the sleeve radially inward to engage the wires whereby the wires are secured within the sleeve.

6. A method of making an electrical contact comprising the steps of:

manufacturing a separate wire sub-assembly from a plurality of straight conductive wires, each wire having a securable end and a primary axis, the manufacturing comprising the steps of:

bundling the wires together into a tight contacting cluster wherein the securable ends are all adjacent to one another and the wire axes are parallel and non-coplanar; and welding the securable ends together, the welding joining the wires together into an integral unit and forming a nugget from the wire material as welded;

inserting the wire sub-assembly into a contact body including a passage for receiving said contact assembly; and mounting said assembly within said contact holder to prevent unauthorized withdrawal therefrom.

7. A method of making an electrical contact as recited in claim 6 wherein said mounting step includes the step of crimping said contact holder forward of said nugget to retain the wire sub-assembly within the contact holder.

8. A method of making an electrical contact for an electrical connector, said contact including a predetermined number of aligned wires held within a sleeve, the steps of the method comprising:

providing a predetermined number of straight wire lengths of approximately equal length with each wire length having a primary axis; and forming a tapered portion onto at least one end of each of the wire lengths;

aligning the axes of each of the wire lengths into parallel non-coplanar relation and gathering the lengths into a bundle with each tapered end portion being adjacent to one another, the tapered end portions defining a forward end of each wire length extending forwardly of the bundle;

welding the other end of the wire lengths together to form a unitary bundle;

surrounding the welded bundle with a sleeve; and securing the bundle of wires in the sleeve by deforming the sleeve radially inwardly into the wires whereby the wire lengths are secured to the sleeve.

9. A method of making an electrical contact for an electrical connector, the steps of the method comprising:

assembling a plurality of straight wire lengths into a bundle, each wire length having a primary axis aligned in parallel non-coplanar relation with the other lengths;

inserting the bundle of wire lengths into a holder for welding;

radially crimping the holder onto the bundle of wire lengths to secure the bundle of wire lengths together within the holder into a tight bundle;

positioning a welding electrode in proximity to one end of the wire lengths;

energizing the electrode to a voltage sufficient to create a welding arc between the electrode and the bundle of wire lengths, said arc providing a securing weld joining the wire lengths into a integral member in response to the voltage; and assembling the welded bundle of wire lengths into a contact sleeve to form the contact.

* * * * *